US007938166B2

(12) United States Patent
Kunstreich

(10) Patent No.: US 7,938,166 B2
(45) Date of Patent: May 10, 2011

(54) ADJUSTING THE MODE OF ELECTROMAGNETIC STIRRING OVER THE HEIGHT OF A CONTINOUS CASTING MOULD

(75) Inventor: Siebo Kunstreich, Saint-Quen (FR)

(73) Assignee: Rotelec, Bagnolet (FR)

( * ) Notice: Subject to any disclaimer, the term of this patent is extended or adjusted under 35 U.S.C. 154(b) by 325 days.

(21) Appl. No.: 12/094,089

(22) PCT Filed: Oct. 18, 2006

(86) PCT No.: PCT/FR2006/002355

§ 371 (c)(1),
(2), (4) Date: May 16, 2008

(87) PCT Pub. No.: WO2007/060301

PCT Pub. Date: May 31, 2007

(65) Prior Publication Data

US 2008/0236780 A1 Oct. 2, 2008

(30) Foreign Application Priority Data

Nov. 28, 2005 (FR) ..... 0512112

(51) Int. Cl.
*B22D 11/00* (2006.01)
*B22D 27/02* (2006.01)

(52) U.S. Cl. ..... 164/468; 164/504

(58) Field of Classification Search ..... 164/468, 164/504

See application file for complete search history.

(56) References Cited

U.S. PATENT DOCUMENTS

| | | | | |
|---|---|---|---|---|
| 4,957,156 | A * | 9/1990 | Mayrhofer | 164/504 |
| 7,201,211 | B2 | 4/2007 | Kunstreich | |
| 2005/0039876 | A1 * | 2/2005 | Eriksson | 164/466 |

FOREIGN PATENT DOCUMENTS

| | | | |
|---|---|---|---|
| EP | 0 550 785 | | 7/1993 |
| EP | 0 750 958 | | 1/1997 |
| EP | 0 778 098 | A2 * | 6/1997 |
| EP | 1 551 580 | | 7/2005 |
| WO | 99 11404 | | 3/1999 |
| WO | WO 2004/035248 | | 4/2004 |

* cited by examiner

*Primary Examiner* — Kevin P Kerns
(74) *Attorney, Agent, or Firm* — Oblon, Spivak, McClelland, Maier & Neustadt, L.L.P.

(57) ABSTRACT

In the continuous casting of flat metal products with a submerged nozzle having lateral outlets, a mold is equipped on each of its long sides with a pair of linear inductors that generate a magnetic field that travels horizontally over a width of the long sides and are placed on sides of the nozzle. The inductors are mounted in pairs to slide vertically over the height of the mold, and by being moved, pass from a low stirring position, located level with the outlets of the nozzle, to a high stirring position, located level with a meniscus of the liquid metal in the mold, and vice versa. Also, on passing from one position to the other, the connections for the inductors to the phases of the power supply are modified to reverse the direction of travel of the magnetic field of only one of the two inductors of each pair.

6 Claims, 3 Drawing Sheets

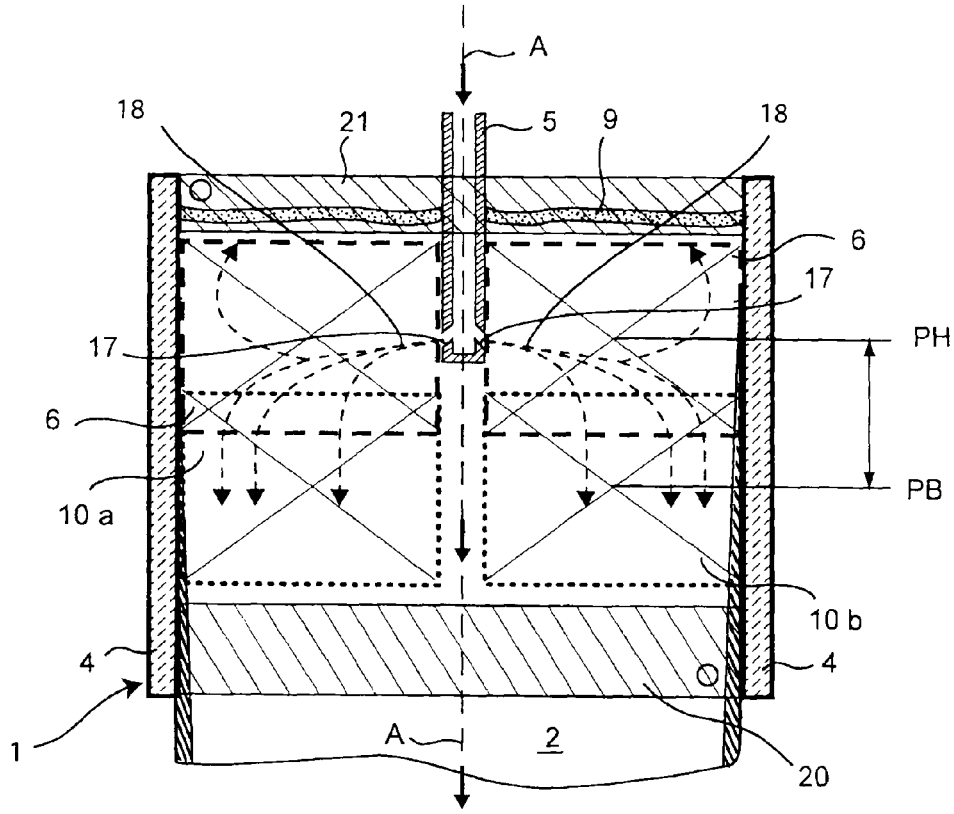
Figure 2
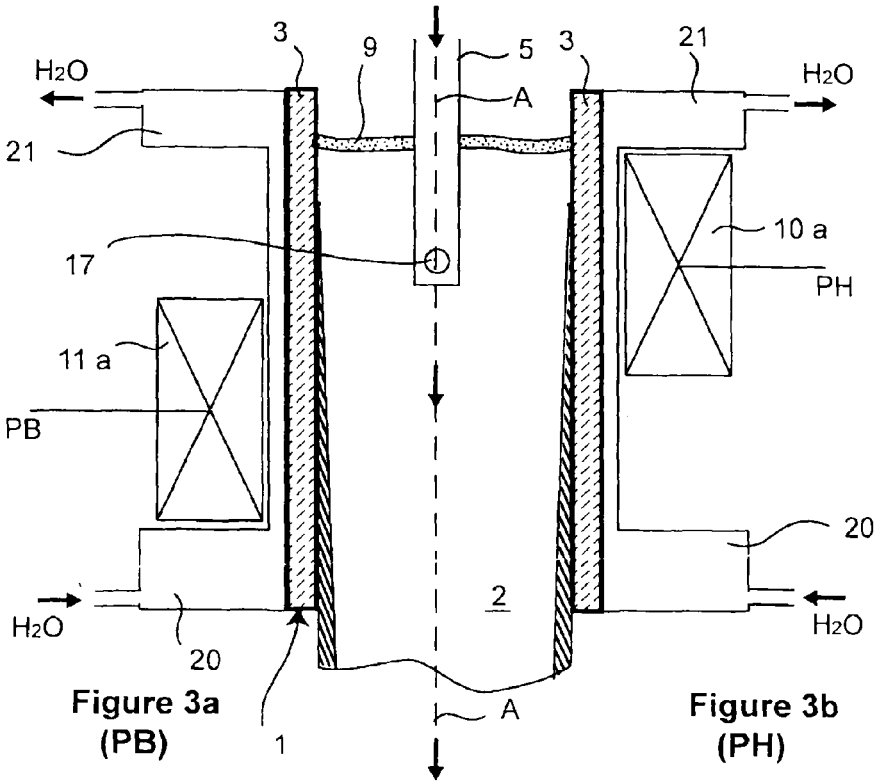
Figure 3a (PB)
Figure 3b (PH)

(HP)

(LP)

(LP)

ADJUSTING THE MODE OF ELECTROMAGNETIC STIRRING OVER THE HEIGHT OF A CONTINOUS CASTING MOULD

BACKGROUND OF THE INVENTION

I. Field of the Invention

The present invention relates to the continuous casting of flat metal products, especially flat steel products. More particularly, the invention relates to the management of the flow pattern of the liquid metal poured into the casting mold by employing electromagnetic forces to improve the quality of the cast products and/or the productivity of the casting plant.

It should be noted that the term "flat products" is understood to mean slabs, narrow slabs, thin slabs, etc. or any other product of "elongate" cross section, that is to say one in which the width is at least twice the thickness.

II. Description of Related Art

The molds with which the flat products are cast conventionally have two long sides (or walls) made of copper or copper alloy, which are vigorously cooled by circulating water in contact with them, said long sides facing each other separated by a distance that defines the thickness of the cast product. These full-face walls adjoin their ends by two short side walls so as to form a sealed casting space that reproduces the desired rectangular section. A system for cooling the walls, comprising water chambers and cooling channels, is designed to ensure that sufficient heat is extracted, via these walls, from the cast metal. Sufficient heat extraction results, at the exit of the mold, in the formation of a solidified metal shell in contact with these cooled walls, said shell being uniform around its perimeter and having a thickness of a few centimeters, so as to give the cast product a mechanically strong envelope in order to allow it to completely solidify under traction in the lower stages of the secondary cooling (direct water jets) of the casting machine.

As is known, the free surface of the cast metal in the mold (this surface will be called hereafter the "meniscus") is generally covered by a covering slag. The metal is therefore poured using a submerged nozzle, which dips a few tens of centimeters below the meniscus in the mold and is provided at its outlet end with lateral outlets via which the liquid metal spurts towards the short sides of the mold.

No one today can ignore the importance of the influence, both on the metallurgical quality (including being inclusion-free) of the cast metal and on the success of the casting operation itself or its productivity, of the flows of molten metal within the casting tube.

This is why, for more than thirty years now, and with various but always technically probative fortunes, steel continuous casting processes always employ electromagnetic forces for the purpose of constraining these liquid metal flows to various circulatory modes, some of which, depending on the situation and the desired effects, are considered to be more appropriate than others.

Electromagnetic stirring used in this way may be performed level with the mold itself and/or level with the secondary cooling zone of the casting machine.

In the case of in-mold stirring, the magnetic field acting through the long copper walls is produced by inductors that are placed either directly submerged in the upper water chamber of the mold or in separate compartments and therefore provided with their own cooling section.

Several types of in-mold electromagnetic stirring are being practiced at the present time. They may be briefly reviewed as indicated below.

A first type (see for example JP 1 228 645 or EP 0750958) consists of a gyratory movement of the molten metal level with the meniscus around the casting axis, so as to improve the quality of the surface of the cast products. To do this, horizontally travelling magnetic fields are applied in the meniscus region over the entire width of the long sides of the mold, the direction of travel being reversed between one long side and the other. To do this, a pair of polyphase inductors, with a flat structure, of the "asynchronous linear motor stator" type, is mounted in the upper part of the mold, each inductor spreading over the entire width of the long side.

A second recommended type of stirring consists in positioning the inductors roughly at mid-height of the mold so as to be able, this time, to apply, at the outlets of the submerged nozzle, a magnetic field that travels on the half-widths of the long sides. This field is produced by flat polyphase inductors mounted facing the long sides of the mold, this time as two pairs of inductors, one pair per long side, the inductors forming a pair being placed symmetrically on either side of the casting axis defined by the nozzle and each covering approximately one half-width of the long side. The assembly formed by these four inductors is connected to one or more polyphase power supplies which provides coherent control of the whole assembly. Thus, the magnetic field produced travels in opposite directions along the two inductors from one pair and in the same direction along the inductors from different sides facing each other on either side of the cast product.

In a first version, often referred to by the term EMLA (see for example EP 1551580), the field travels to the outside, that is to say from the nozzle towards the short sides of the mold, and therefore cocurrently with the jets of molten metal arriving in the mold via the nozzle outlets. The primary purpose in this case is to promote, or stabilize, a configuration called a "double roll" of the liquid steel flow in the mold. A "double roll" configuration proves to be favourable, in particular for uniform influx of heat in the region of the meniscus, that naturally tends to cool by heat loss during casting, despite the presence of the covering slag.

In another version, referred to by the term EMLS (see for example EP 0 550 785), the magnetic field this time travels inwards, from the short sides towards the nozzle, and therefore countercurrently with the metal jets arriving in the mold. The purpose in this case is to "brake" the jets of metal so as to moderate their intensity in order to reduce the fluctuations in meniscus level and turbulence caused by too great a flow velocity.

Of course, these various examples do not constitute an exhaustive list of the possible ways of employing in-mold electromagnetic stirring for continuous casting currently available to the metallurgist. However, they do represent the two broad classes of stirring currently recommended for casting flat products (rotation at the meniscus or assistance to the jets emanating from the nozzle by braking or accelerating) which the metallurgist is confronted with when he has to make a choice in favour of one technology and rejecting the other. At the present time each stirring technology is exclusively, or almost exclusively, dedicated to one of these two aforementioned stirring modes so that the choice of stirring equipment is constricting, as being selective of the single type of stirring that this equipment will permit, the satisfactory operating conditions in all cases.

BRIEF SUMMARY OF THE INVENTION

The object of the invention is to alleviate this drawback by proposing, for the continuous casting of flat products, a simple but versatile electromagnetic stirring tool.

For this purpose, the subject of the invention is a method for adjusting the mode of electromagnetic stirring of the liquid metal over the height of a mold for the continuous casting of flat metal products with a submerged nozzle provided with lateral outlets directed towards the short sides of the mold, said mold being equipped, on each of its long sides, with a pair of polyphase linear inductors generating a magnetic field that travels horizontally over the width of said long side and are placed on either side of the casting axis defined by the nozzle, each inductor being connected to a power supply which provides coherent control of the set of four inductors, the adjustment being characterized:

in that, since the inductors are mounted so as to slide over the height of the mold, said inductors, by being moved vertically, pass from a low functional position LP, by acting at the outlets of the casting nozzle, in which position the direction of travel of the field is reversed between the inductors of any one pair and maintained between the two inductors facing each other on two different pairs, to a high functional position HP, by acting at the meniscus of the liquid metal in the mold, in which position the field travels in the same direction over the inductors from any one pair and in the opposite direction between the two pairs, and vice versa; and in that, on passing from one functional position to the other, the direction of travel of the magnetic field of only one of the two inductors of any one pair is reversed, as is the direction of travel among the two inductors of the other pair, which is symmetrical with respect to the casting axis.

Thus, the invention consists, on the basis of electromagnetic equipment conventionally formed by four linear inductors generating a horizontally travelling field, which are placed on either side of the casting axis on each of the long sides of the mold, in providing:

an arrangement whereby this equipment can be moved in a vertical direction, that is to say over the height of the mold (for example using worm gears, hydraulic cylinders, racks and pinions, or any other suitable means); and means for switching the current at the power supply, allowing the direction of travel of the magnetic field produced by at least two inductors among the four to be reversed, one inductor once chosen on the long side, the other then being chosen on the other side in a symmetrical position with respect to the casting axis.

Consequently, as will doubtless have already been understood, with one and the same electromagnetic stirring equipment, it is easily possible:

either to operate cocurrently or countercurrently (EMLA or EMLS) with the jets of metal entering the mold at the outlets of the casting nozzle (low operating position LP of the equipment near the middle of the mold);

or to make the cast liquid metal rotate about the casting axis level with the meniscus in the mold (high operating position HP of the equipment).

Complementarily, the subject of the invention is also electromagnetic stirring equipment for a continuous casting mold for flat metal products, which implements this method, said equipment comprising:

a battery of at least four travelling-magnetic-field linear inductors;

at least one polyphase power supply for supplying said inductors and provided with an inverter for at least two of the four inductors; and motor-driven means for moving said battery over the continuous casting mold intended to accommodate said battery, said means being capable of moving the battery vertically between at least two functional positions, HP and LP, separated from each other over the height of the mold.

It should be pointed out that there already exists in the prior art continuous casting molds for vertically modifying the position of incorporated electromagnetic stirring equipment. However, such molds are intended for the continuous casting of blooms or billets, that is to say long products, and the inductor in question is, consequently, a single annular one, exclusively dedicated to rotating the cast metal (cf. U.S. Pat. No. 4,957,156 or EP 0 778 098).

As regards flat products, equipment already exists for applying a magnetic field at various heights on the mold. Document WO 99/11404 for example describes an installation of this type. However it should be pointed out that this type of installation proposes in fact to place several sets of inductors, mounted in fixed positions, one on top of another, along the long sides of the mold.

BRIEF DESCRIPTION OF THE DRAWINGS

The invention will be understood and other aspects and advantages will become more clearly apparent in view of the following description, given by way of example and with reference to the appended plates of drawings in which:

FIG. 2 shows schematically, in a vertical mid-plane passing through the casting axis and parallel to the long sides of the mold, the two functional positions, the high position HP and the low position LP, of the battery of inductors that can be moved over the height of the mold;

FIG. 3 (part 3*a* and 3*b*) is a representation similar to that of FIG. 2, but this time in a view parallel to the short sides of the mold;

In the figures, the same elements are denoted by the same reference numbers.

DETAILED DESCRIPTION OF THE INVENTION

It will have been understood that the implementation of the invention consists in allowing the inductors to slide vertically along the long side of the mold by modifying, at the same time, some of their connections to the power supply so as to modify their stirring action depending on the point along the height where they are located.

Figure 1:
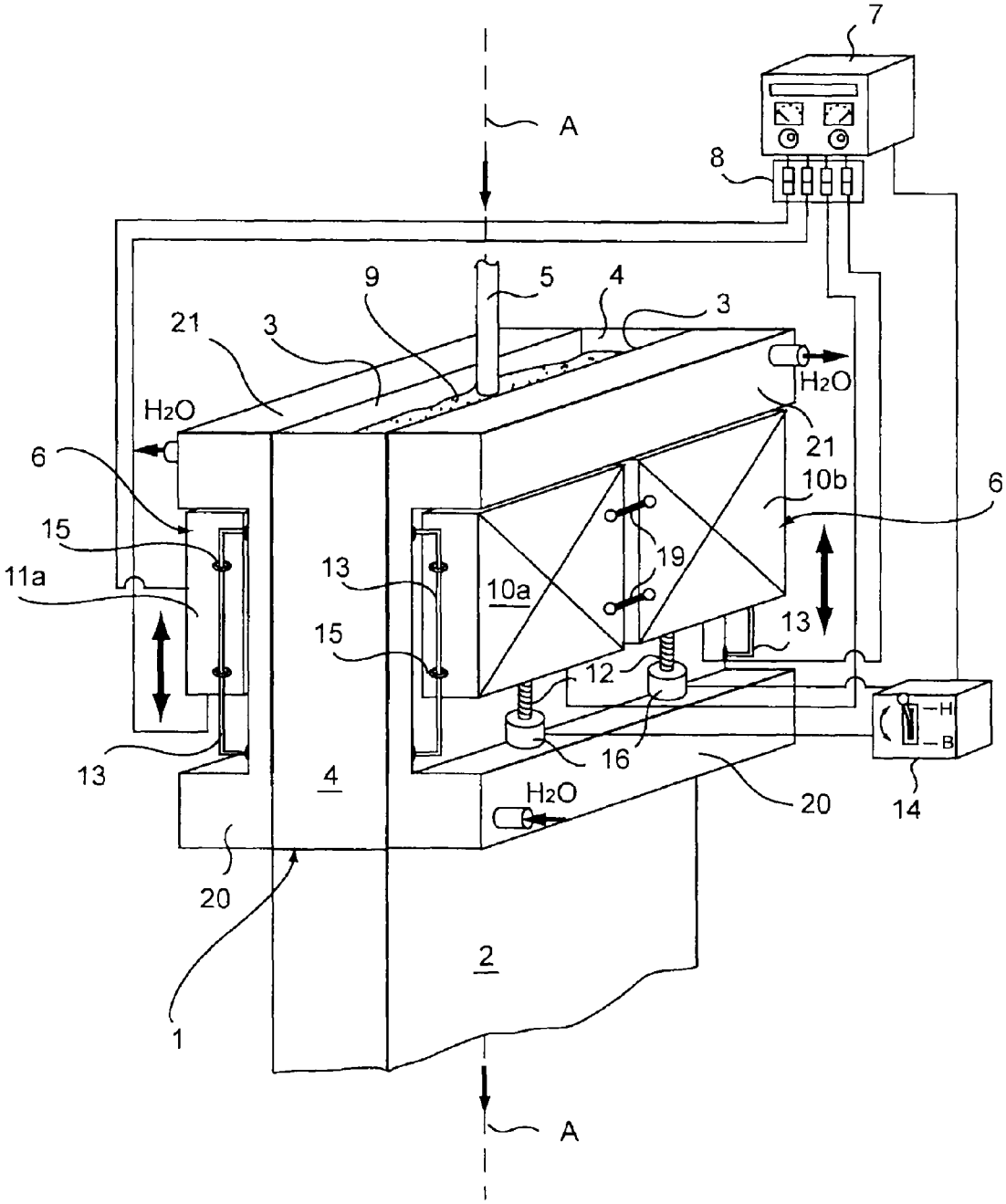
FIG. 1 is a general schematic view, in side elevation, of a mold for the continuous casting of steel slabs, which is equipped with the means according to the invention.

FIG. 1, showing a mold 1 for casting steel slabs 2, illustrates in a general manner the means for implementing the invention. Conventionally, this mold comprises two pairs of plates (two long plates 3 and two short plates 4) made of copper or copper alloy, which are cooled by the vigorous circulation of water flowing against their external surface from a water inlet lower chamber 20 to a water outlet upper chamber 21. The contiguous sealed assembly of the set of these four plates defines the casting space, of rectangular elongate shape. The term "elongate shape" refers to a geometry of the cast product, the long sides of which are at least twice the length of the short sides.

The casting space of the mold is fed with liquid metal via a submerged nozzle 5 centred on the casting axis A, the top end of the nozzle being sealably fastened to the opening in the bottom of a tundish (not shown) placed a short distance thereabove. The free bottom end of the nozzle, better seen in FIGS. 2 and 3, is provided with lateral outlets 17 directed towards the short sides 4. This end conventionally dips into the mold to a depth of about 15 to 30 cm below the free surface (or meniscus) 9 of molten metal in the mold, i.e. about 25 to 40 cm below the upper edge of the copper plates.

An electromagnetic stirring unit 6, connected to a two-phase or three-phase power supply 7, is mounted facing the long sides 3 of the mold. More precisely, this stirring unit is mounted in the recess usually left available between the upper water chamber 21 and the lower water chamber 20, which chambers both either form boxes, each with a height of about 20 cm, placed just behind the terminal portions of the long plates 3.

The power supply 7 incorporates a converter so as to be able to vary the frequency of the current. It is by choosing the frequency of the inductor excitation current that the travel speed of the magnetic field produced is set. By adjusting the intensity of this current, the intensity of the magnetic field can be adjusted.

The electromagnetic stirring unit 6 comprises a battery of four linear inductors (10*a*, 10*b* and 11*a*, 11*b*), which are preferably identical, of the "asynchronous linear motor stator" type. These are preferably flat inductors, of conventional technology, with wound salient magnetic poles of elongate shape along the vertical direction and arranged so as to be parallel to one another over the length of the inductor, said length being determined so as to be able to cover approximately one half-width of the long plates 3 of the mold. The windings around the magnetic poles are advantageously formed by hollow conductors cooled by the internal circulation of a cooling fluid, preferably treated water. They thus possess their own feeding circuit, independently therefore of that for cooling the mold that receives them. These inductors are between about 200 and 300 mm in height as regards their active part (pole faces of the poles), i.e. between 400 and 500 mm overall, taking into account the winding heads, which project on either side of the poles.

The four inductors are grouped two by two in pairs 10*a*, 10*b* and 11*a*, 11*b*, with one pair of inductors for each long side 3 of the mold. The inductors of one pair are placed on either side of the nozzle 5, and the two pairs face each other on either side of the cast product 2. The inductors of any one pair are fastened, a certain distance (about 10 cm) apart, by attachments 19 in order to form a mechanically rigid assembly.

They are connected individually to the power supply 7. A switch unit 8 is provided at this power supply in order to allow the direction of the current to be reversed, and therefore to allow the magnetic field produced to travel, in at least two inductors of different pairs.

According to the invention, the inductors are mounted so as to move in vertical translation over the mold. The use of conventional means for moving heavy loads, such as hydraulic cylinders, rack-and-pinion systems, mechanical attenuators, such as motor-driven worm gears, etc., is perfectly possible and even recommended. However, the amplitude of operation must be capable of allowing the battery of inductors 6 to be moved over about 10 or 20 cm, or even more. Experiments have shown in fact that this relatively small displacement in height is sufficient to allow the means of the invention to act with the required selectivity on the liquid metal in the mold, as will be seen in greater detail later on.

Since the inductors are moved vertically, it is advantageous, because the moveable assembly weighs several tons, to provide, on either side of each pair of inductors, guide rails 13 that cooperate with eyelets 15 provided for this purpose at the top and bottom ends of the outer edges of each inductor in order to ensure that the battery of inductors is moved correctly.

This vertical movement is provided by motor-driven control means, which include an actual control unit 14, controlling the operation of hydraulic cylinders or, as exemplified here, reversible electric motors 16 mounted on the end of screw jacks 12. Thus, by axial rotation of the worm gears 12, the battery 6 of inductors is moved vertically between a high functional position, acting level with the meniscus 9, and a low functional position, acting level with the outlets of the nozzle 5.

This unit 14 is connected to the power supply 7 in order to activate the switching unit 8 during these movements and thus make the necessary reversals in the connections of the inductor windings to the phases of the power supply. Since each inductor produces, by construction, a magnetic field that travels horizontally over one, and only one, half-width of the long sides 3 of the mold, depending on the way in which it is electrically connected, this field will be directed either outwardly (from the nozzle to the short side) or inwardly (from the short side to the nozzle).

In what follows, reference will be made jointly to FIGS. 2 to 5 so as to have a more complete approach of the means employed for carrying out the invention.

To begin with, a few dimensional details, useful for properly understanding the invention, will be given. It should be emphasized beforehand that the functional position of the inductors over the height of the mold, by nature a moveable position according to the invention, includes, of course, end-of-travel stops constrained by the height dimension of the inductors themselves and by the overall size of the members of the mold that are present at this point, especially the upper water chamber.

A current mold for the continuous casting of steel slabs has a length of about 900 mm. Its upper 21 and lower 20 water boxes themselves measure about 200 mm in height. The available recess between them is therefore 500 mm. If the inductors are 400 mm in height, this recess is of sufficient size to accommodate them and allow them to move heightwise over a distance of about 10 cm.

It has been found that such an amplitude of movement is sufficient to implement the invention. However, it is perfectly possible to increase it to more than about 10 cm by correspondingly reducing the height of the upper water box 21, without thereby impairing the efficiency of the mold cooling. It is in respect of this constructional variant that the appended figures have been given. Thus, an amplitude of movement over the height of about 20 cm is provided. Of course, this affords greater selectivity in the desired respective stirring actions carried out on the cast metal level with the meniscus or level with the nozzle outlets.

To describe this mobility geometrically, it is convenient to take the point at mid-height on the active part of the inductors as a level reference. This is an arbitrary choice and it would of course be possible to choose another reference on the inductor, for example on its upper edge, without this in any way changing the implementation of the invention or its understanding.

Thus, when the battery of inductors 6 is raised to the maximum height so as to butt against the bottom of the upper box 21, the stirring configuration is in the high functional position HP. In other words, the reference point, at the middle of the active parts, is located at a height dimension denoted by HP. Although this active part of the inductors is necessarily shifted downwards with respect to the level of the meniscus 9, the point where the stirring action is therefore desired, in the high functional position HP, this action is nevertheless effectively felt in the meniscus region. The inductors (shown by the bold dotted lines in FIG. 2) are then connected to the power supply in order to generate a gyratory movement on the surface of the molten metal around the casting axis A. For this purpose, the two inductors 10*a*, 10*b* of any one pair 10 generate a field that travels in the same direction (from the left to the right in FIG. 4), and therefore having a uniform stirring effect over the entire width of the associated long side. However, the direction of travel of the field is reversed from the pair 10 to the other pair 11 over the other long side of the mold.

When the battery of inductors is lowered by 10 or 15 cm downwards, therefore approximately to mid-height of the mold, or even as far as butting against the lower box 20 (cf. FIG. 3*a*), the stirring configuration is in the low functional position LP. In the low functional position LP, the electromagnetic stirring is strongly felt at the outlets 17 of the nozzle 5, at the point where it is therefore desired, although the active part of the inductors is, here again, shifted downwards with respect to this level. The inductors are then connected to the power supply 7 so as to generate magnetic fields travelling cocurrently (FIG. 5*a*) or countercurrently (FIG. 5*b*) with the jets of metal 18 emanating from the outlets towards the short sides 4 of the mold. It will be recalled that the cocurrent configuration is synonymous with jet acceleration (of the EMLA type), whereas the countercurrent configuration, therefore of the EMLS type, is synonymous with jet "braking".

At this stage, it may be useful to provide the following details. As was already emphasized at the beginning, it is in fact sufficient to move the inductors over a maximum of 10 or 15 cm upwards from a position approximately midway along the mold in order to be able to discriminate a stirring action level with the outlets from a stirring action level with the meniscus, and vice versa. Experience shows that, even though this is not located at the core of the active part of the inductors, whenever the point where it is desired to exert the stirring action over the height of the mold lies, if not in this active portion, at least in its immediate vicinity, this action proves to be fully effective. Moreover, if required, the reserve of power delivered by the power supply may compensate for any reduction in electromagnetic force created at the required point of stirring action over the height of the mold due to this point being away from the active part of the inductors.

Having explained these details, the normal course of the description continues. According to the invention, on passing from the low position LP to the high position HP, or vice versa, the control unit 14 acts on the switching unit 8 in order to reverse the electrical phase connections for only two inductors located in axial symmetry with respect to the nozzle 5, each on one long side 3 of the mold, so as to reverse the direction of travel of the magnetic field that they generate. To do this, it is sufficient to act on any two phases of the three of a three-phase supply, or to reverse the direction of the current of one phase in the case of a two-phase supply.

Thus, by passing from the low position LP to the high position HP, stirring is set up so as to generate an axial rotational movement of the liquid metal in the upper part of the mold. In contrast, on passing from the high position HP to the low position LP, the operator is left with the choice of assistance for the fresh metal jets emanating from the nozzle, by linear magnetic stirring, the action of which may be implemented in jet accelerator mode (FIG. 5*a*) or jet braking mode (FIG. 5*b*).

Figures 4, 5A, 5B:
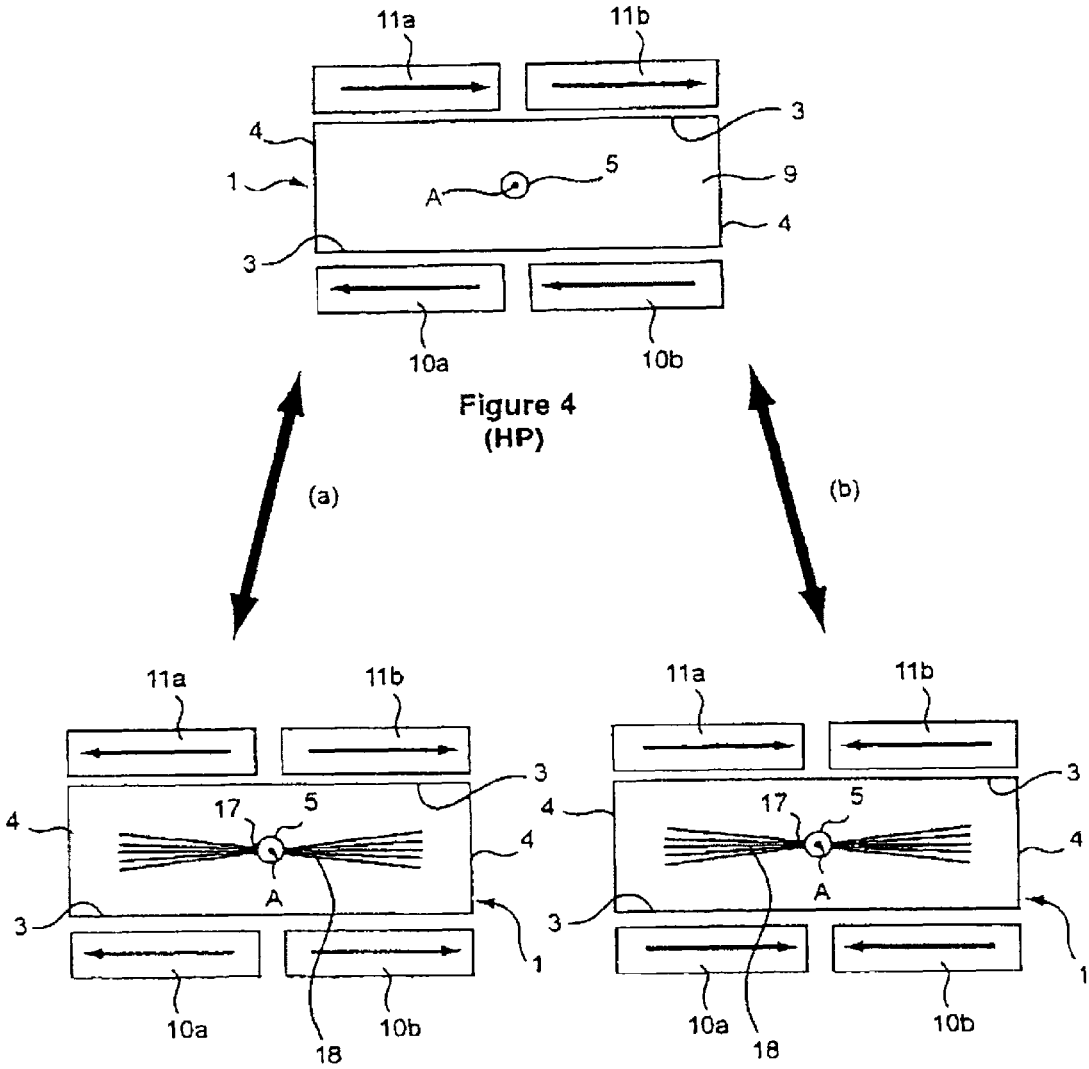
FIG. 4 is a diagram, seen from above the mold, showing the principle of the mode of action of the travelling-magnetic-field inductors when these are in the high functional position HP.
FIGS. 5*a* and 5*b* show, respectively, in a view similar to FIG. 4, the mode of action of the travelling-magnetic-field inductors when these are in the low functional position LP.

More precisely, in the case exemplary in the figures:

a) the inductors pass from a high functional position HP for rotational stirring, shown in FIG. 4, in which consequently the magnetic fields of the inductors 10*a* and 10*b* both travel from the left to the right and the fields of the facing inductors 11*a* and 11*b* both travel from the right to the left (the contrary being perfectly equivalent moreover), to a low position LP for linear stirring in which two possibilities are presented:
   - either, as shown in FIG. 5*a* (path a), the direction of travel of the magnetic field of the inductor 10*a* and the inductor 11*b* is reversed (the inductor 11*b* being symmetrical to the inductor 10*b* with respect to the casting axis A) in order to be in a cocurrent stirring configuration with respect to the incoming jets of metal 18 (EMLA mode)
   - or, as shown in FIG. 5*b* (path b), the direction of travel of the field of the inductor 10*b* and the inductor 11*a* (its symmetric inductor with respect to the casting axis A) is reversed so as to be in a linear stirring configuration of the type countercurrent with the jets (EMLS mode); and b) conversely, the inductors pass from a low functional position LP for linear stirring:
   - in cocurrent mode (FIG. 5*a*), to a high position HP for rotary stirring (FIG. 4 (path a)) by reversing the direction of travel of the magnetic field produced by just the inductors 10*a* and 11*b*,
   - or, in countercurrent mode (FIG. 5*b*), to this same high position HP for rotary stirring (FIG. 4 (path b)) by reversing the direction of travel of the magnetic field produced by just the inductors 10*b* and 11*a*.

Of course, the power supply 7 delivers current intensities and frequencies that can be adjusted to values chosen in advance. The control unit 14, which is connected to the power supply, can manage this possibility so as to vary the intensity of the applied force. This is because, although in "accelerator" (EMLA) mode it is advantageous for the four inductors to exert a similar force on the metal, this configuration is not always desirable for the gyratory movement level with the meniscus. For example, it may be advantageous for the two inductors, the field of which travels against the flow of liquid metal, to provide a larger magnetic force than the others.

It goes without saying that the invention is not limited to the examples explicitly given in the present specification, rather it extends to many variants or equivalents provided that its definition given by the appended claims is respected.

For example, a system based on a single drive motor with a chain and gears mounted on the end of screw jacks 12 may replace the system described, having individual motors by jacks.

Moreover, it is possible to devise a way of winding the inductors in which the winding heads (i.e. electrical parts that project beyond the magnetic circuit) are no longer vertical, as is standard practice, but folded outwards, at least as regards the upper winding heads. Thus, it is possible, where required, to gain slightly in terms of end-of-travel distance when the battery of inductors butts against the bottom of the box of the upper water chamber in order to be in the high operating position.

Furthermore, the electrical conductors forming the windings of the inductors may be solid conductors. Temperature maintenance of the inductors may in this case be provided by immersing each pair of inductors in a sealed box through which a cooling liquid circulates.

Moreover, the invention may of course be implemented both during any one casting run and between two successive casting runs.

The invention claimed is:

1. A method for adjusting a mode of electromagnetic stirring of liquid metal over a height of a mold having two long sides and two short sides for continuous casting of flat metal products, the method comprising:

providing a submerged nozzle with lateral outlets directed towards the short sides of the mold;

equipping said mold, on each of the long sides, with a pair of polyphase linear inductors that generate a magnetic field that travels horizontally over a width of said long sides;

placing the pair of the inductors on each of the long sides of the nozzle such that one pair is symmetrical to another pair about a casting axis; and connecting each of the inductors to a power supply which provides coherent control of the four inductors, wherein the inductors are mounted to slide vertically over the height of the mold such that said inductors are movable between a low functional position acting at the outlets of the nozzle, in which position a direction of travel of the field is reversed between the inductors of any one pair and maintained between the two inductors facing each other on two different pairs, and a high functional position acting at a meniscus of the liquid metal in the mold, in which position the field travels in the same direction over the inductors from any one pair and in the opposite direction between the two pairs; and wherein on passing from one functional position to the other, electrical connections for the inductors to said power supply are modified to reverse the direction of travel of the magnetic field of only one of the two inductors of each pair.

2. The method according to claim 1, further comprising reversing an electrical connection for two inductors placed symmetrically with respect to the casting axis on two different pairs to generate a gyratory movement within the liquid metal when the inductors pass from the low position to the high position.

3. The method according to claim 1, further comprising reversing an electrical connection for two inductors placed symmetrically with respect to the casting axis on two different pairs to generate a stirring effect at a core or countercurrently with respect to jets of metal emanating from the outlets of the casting nozzle when the inductors pass from the high position to the low position.

4. The method according to claim 3, further comprising reversing electrical connections for the inductors whose magnetic field produced hitherto traveled in a direction going from a short side of the mold to the nozzle to generate an effect cocurrent with the jets.

5. The method according to claim 3, further comprising reversing electrical connections for the inductors whose magnetic field produced hitherto traveled in a direction going from the nozzle to a short side of the mold to generate an effect countercurrent with the jets.

6. The method according to claim 1, wherein in the high functional position a rotational stirring of the mold is performed and in the low functional position a linear stirring of the mold is performed.

* * * * *